US005441547A

United States Patent [19]

Durrfeld et al.

[11] Patent Number: 5,441,547

[45] Date of Patent: Aug. 15, 1995

[54] METHOD FOR GASIFICATION OF A FINELY DIVIDED COMBUSTIBLE MATERIAL

[75] Inventors: Rainer Durrfeld, Essen; Johannes Kowoll, Bochum; Eberhard Kuske, Essen; Hans Niermann, Essen; Gerhard Wilmer, Hattingen; Joachim Wolff, Essen, all of Germany

[73] Assignee: Krupp Koppers GmbH, Essen, Germany

[21] Appl. No.: 201,364

[22] Filed: Feb. 24, 1994

[30] Foreign Application Priority Data

Mar. 16, 1993 [EP] European Pat. Off. ..... 93104291

[51] Int. Cl.[6] ..... C10J 3/46

[52] U.S. Cl. ..... 48/197 R; 48/206; 48/210

[58] Field of Search ..... 48/197 R, 202, 203, 48/206, 210, DIG. 2, 67, 69, 63, 64, 62 R, 76, 77, 87; 122/7 R; 110/215, 235; 422/207

[56] References Cited

U.S. PATENT DOCUMENTS

| | | | |
|---|---|---|---|
| 4,493,291 | 1/1985 | Zabelka | 48/67 |
| 4,859,214 | 8/1989 | Segerstrom et al. | 48/197 R |
| 4,936,871 | 6/1990 | Wilmer et al. | 48/197 R |
| 4,950,308 | 8/1990 | Lang et al. | 48/62 R |
| 4,954,136 | 9/1990 | Jokich | 48/197 R |
| 5,230,717 | 7/1993 | Ogawa et al. | 48/67 |

FOREIGN PATENT DOCUMENTS

| | | | |
|---|---|---|---|
| 0115094 | 8/1984 | European Pat. Off. . | |
| 2164951 | 4/1986 | United Kingdom | 48/197 R |

OTHER PUBLICATIONS

Trefz, et al, Chem. Eng. Technol. 16, (1993), 153–160.

*Primary Examiner*—Peter Kratz

*Attorney, Agent, or Firm*—Michael J. Striker

[57] ABSTRACT

The gasification process includes providing a gasification reactor for gasifying a finely divided combustible material under pressure to form a crude gas with cinder and ash components, a quenching pipe positioned concentrically above the gasification reactor, a convection-heated boiler concentrically surrounding the quenching pipe and a gas flow guide device above the quenching pipe, the gas flow guide device being rotationally symmetric with respect to a longitudinal axis of the quenching pipe; conducting the crude gas with the cinder and ash components from the gasification reactor into the quenching pipe; feeding a quenching gas into the quenching pipe during the gasifying to form a mixed flow including the crude gas, the cinder and ash components and the quenching gas; guiding the mixed flow about a 180° turn with the gas flow guide device above the quenching pipe; conducting the mixed flow into the convection-heated boiler; feeding the mixed flow from the convection-heated boiler with the help of a gas outlet device; and adjusting a gas flow speed of the mixed flow so that the cinder and ash components travelling in the mixed flow experience a cooling in the convection-heated boiler so that they loose adherence ability and are conducted through the gas outlet device from the convection-heated boiler.

5 Claims, 7 Drawing Sheets

METHOD FOR GASIFICATION OF A FINELY DIVIDED COMBUSTIBLE MATERIAL

BACKGROUND OF THE INVENTION

The invention relates to a method of gasification of a finely divided combustible material under pressure for production of a useable commercial gas in a single step.

A gasification apparatus for a gasification under pressure is known including a gasification reactor, a quenching pipe for crude gas issuing from the gasification reactor and a convection-heated boiler with convection heating surface elements for receiving the heat from the crude gas.

Finely divided combustible material means fine grained to dust-like combustible material. Particularly this material can be a fuel such as coal. The energy is supplied to the gasification reactor by burner, which also entrains predominantly the finely divided combustible material. The gasification reaction is controlled in regard to thermodynamic considerations so that a commercially useful gas of a predetermined composition is produced. Reactions are frozen, so to speak, in the quenching pipe by chilling. Furthermore a quenching gas is admitted to the quenching pipe. The expression "gas" also mean "vapor" in the scope of the present invention. The walls of the gasification reactor, of the convection-heated boiler and of other components for the purpose of high-temperature cooling, e.g. a boiling water cooling, are provided with pipe walls made from welded parallel pipes or with pipes in a gasification apparatus of the above-described type. The convection-heated boiler is provided with convection heated surface elements. This is also true in the apparatus according to the invention. It is understood that the heat received by the pipe walls and in the convection-heated boiler is utilized.

In the known gasification method, on which the invention is based and which is described in European Patent Document 0 115 094, the tower-like gasification apparatus has two towers, which stand next to each other. That is an expensive construct method. On the other hand, it is often done to guarantee that no interference in operation is caused by deposited cinder and/or ash particles during the gasification. Nevertheless the operational reliability often must take troublesome strand formation into the bargain, i.e. strand formation cannot be avoided and must be considered.

SUMMARY OF THE INVENTION

It is an object of the present invention to provide a gasification method for gasification of a finely-divided combustible material under pressure to form a commercially useable gas, which is characterized by simple process steps and a high operational reliability and can be performed by a simple and compact gasification apparatus.

According to the invention, the gasification method for gasification of a finely divided combustible material under pressure comprises:

a) providing a gasification reactor for a gasification of a finely divided combustible material under pressure, a quenching pipe positioned concentrically above the gasification reactor and a convection-heated boiler surrounding the quenching pipe;

b) conducting a crude gas together with cinder and ash components generated during a gasification in the gasification reactor upwardly into the quenching pipe;

c) feeding a quenching gas into the quenching pipe to form a mixed flow of the crude gas, the cinder and ash components and the quenching gas;

d) guiding the mixed flow about a 180° turn by a gas flow guide device provided above the quenching pipe, the gas flow guide device being rotationally symmetric with respect to a longitudinal axis of the quenching pipe;

e) conducting the mixed flow into the convection-heated boiler downstream of the gas flow guide device, the convection-heated boiler being concentric to the quenching pipe; and f) withdrawing the mixed flow from the convection-heated boiler with the help of a gas outlet device of the convection-heated boiler;

g) adjusting a gas flow speed of the mixed flow so that cinder and ash components travelling with the mixed flow about the 180° turn are conducted into the convection-heated boiler and experience a cooling in the convection-heated boiler so as to loose an adherence ability therein and thus;

h) the cinder and ash components are conducted from the convection-heated boiler.

The method according to the invention is based on the understanding that in gasification of finely divided combustible material a gas flow having spin components is produced by the dome-like gas guide means with an axially symmetric guide baffle for guiding the gas flow about a 180° turn Thus surprisingly the thermodynamically troublesome strand build-up is avoided. Surprisingly the spin components in the gas flow through the convection-heated boiler induce a turbulence spectrum with largely homogeneous isotropic turbulence, which improves the heat transfer. Without difficulty the flow speed of the gas flow can thus be adjusted or set so that cinders and ash particles travelling with the gas flow are transported into the convection-heated boiler by the 180° guiding, and indeed in a very uniform distribution. The gas flow speed thus set in the quenching pipe leads simultaneously to a very uniform spin and turbulent flow phenomenon. As a result, the convection-heated boiler has a comparatively reduced structural height, so that the cinder and ash particles experience a cooling until their ability to adhere is lost on their way through the quenching pipe and through the convection-heated boiler. Without more the flow speed in the gas outlet device is set so that the cinders and ash particles travelling with the gas flow are conducted out of the convection-heated boiler to a location where they can be deposited. The process according to the invention allows a fire-resistant lining previously required in the gasification apparatus to be abandoned or eliminated. Clopping devices are generally considered to be sufficient.

The method of the invention are particularly outstanding, when the mixed gas including the crude gas and the quenching gas flows over the concentric convection-heated surface elements of the convection-heated boiler and is cooled to a temperature of 400° to 200° C. at the entrance of the gas outlet device. In a preferred embodiment of the method according to the invention by feeding in a quenching gas in a transverse flow into the crude gas in the quenching pipe through a quenching gas inlet gap between the gasification reactor and the quenching pipe so that the inflow of quenching gas is uniformly distributed over the entire circumference of the quenching gas inlet gap strand formation and disadvantageous influences on the thermodynamics of the method are suppressed. Advantageously there are no structural elements obstructing the quenching gas inlet gap between the quenching pipe and the gasification reactor.

In the method according to the invention the concentric convection-heated surface elements surround the quenching pipe. A ring space with a ring-like cross-section is provided for the convection-heated surface elements, by which comparatively large convection-heated surface can be provided. While the tower-like boiler of the prior art with the concentric convection-heated surface elements in the center has a region of comparatively reduced thermodynamic effectiveness, in the method of the invention this region is used for the quenching pipe. The apparatus, which results from the teaching of the method of the invention in practice, has a comparatively higher output and comparatively larger throughput. The heat transfer and thus the cooling of the gas flow occurs very intensively, because there is a gas flow of cooling gas on both sides of the wall of the quenching pipe and also the convection-heated surface elements. To guide the cooled gas flow into the outlet, the cinder and ash particles are not deposited in the gas outlet device according to the invention, but a spin component is provided for the gas flow in the gas outlet device at the outlet of the convection-heated boiler and the flow speed and the spin in the gas outlet device are set so that the cinder and ash particles are conducted out of the apparatus in the gas flow.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENT

Figure 1:
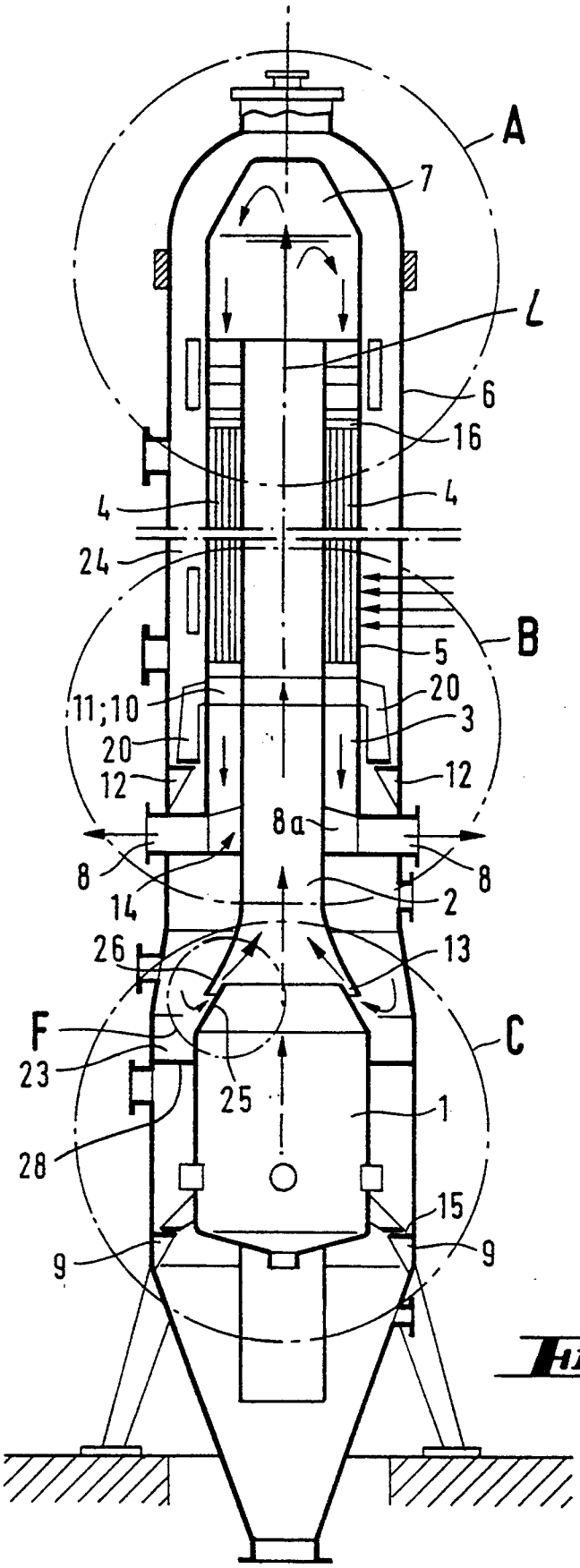
FIG. 1 is a vertical cross-sectional view through a gasification apparatus for performing the method according to the invention.

The gasification apparatus shown in the drawing is equipped and designed for the pressure gasification of a finely divided combustible gas to produce a commercially useable product gas in a single operation. A middle section, whose length corresponds approximately to the length of the illustrated lower section, is not shown in FIG. 1.

This gasification apparatus consists essentially of a gasification reactor 1, a quenching pipe 2 for the crude gas issuing from the gasification reactor and a convection-heated boiler 3 with convection heated surface elements 4 for receiving the heat of the crude gas. The convection heated surface elements 4 are arranged to form concentric cylinders. As already mentioned the apparatus comprises pipe walls formed from pipes or pipe sections welded together, which, for their part, extend parallel to each other.

Figure 2:
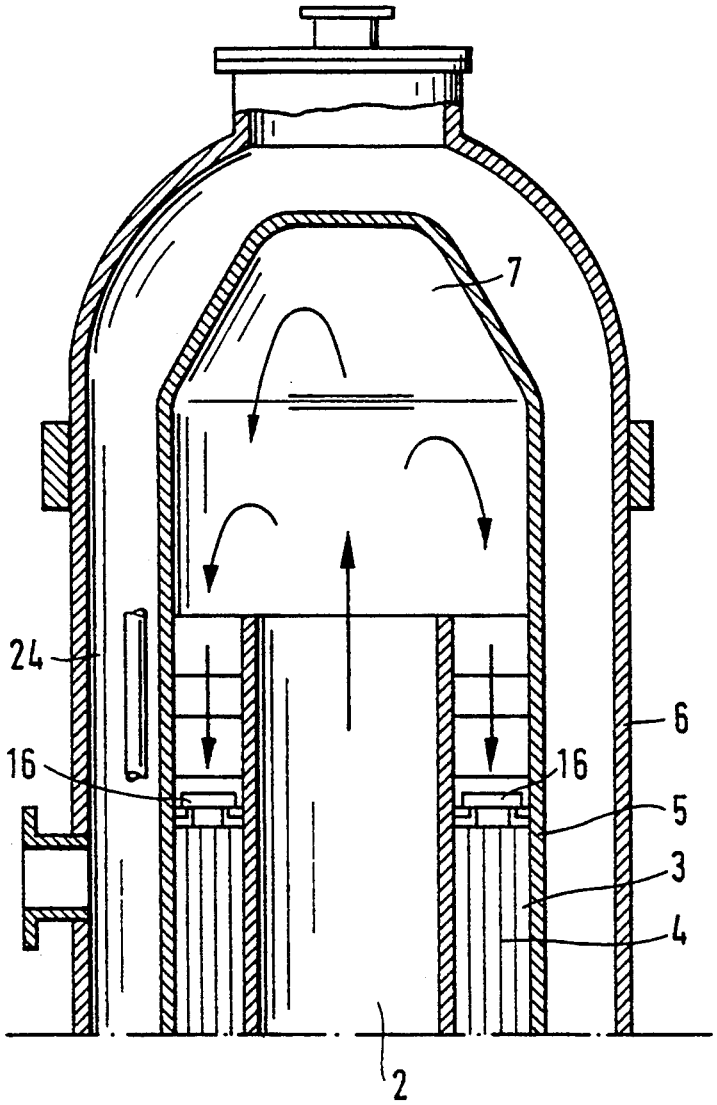
FIG. 2 is a detailed cutaway cross-sectional view of a top portion A of the gasification apparatus of FIG. 1.

The gasification reactor 1, the quenching pipe 2 and the convection-heated boiler 3 with its boiler housing 5 are arranged in a pressurized vessel 6. The convection-heated boiler 3 surrounds the quenching pipe 2 concentrically. The gasification reactor 1 is coaxial to and under the quenching pipe 2. Also the boiler housing 5 is advantageously made from pipe walls. One observes in the upper portion of the apparatus shown in FIGS. 1 and 2 that a group of convection heated surface elements 4 are suspended on the quenching pipe 2 and in the boiler housing 5. In the same way additional bundles or groups of convection heated surface elements can be arranged and distributed over the entire height of the gasification apparatus.

Figure 3:
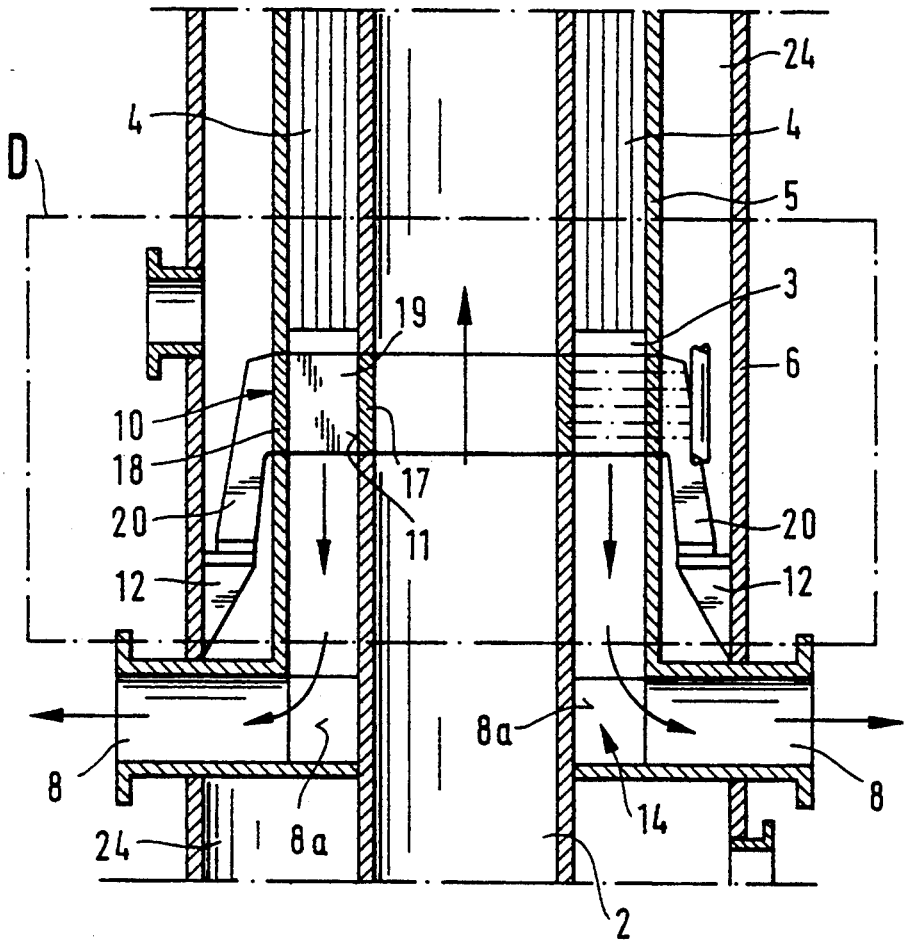
FIG. 3 is a detailed cutaway cross-sectional view of a middle portion B of the gasification apparatus of FIG. 1.

A gas flow guide device 7 for the crude gas conducted into the convection-heated boiler 3 and issuing from the quenching pipe 2 is arranged and constructed above the quenching pipe 2 in the boiler housing 5. This gas guide device 7 is shown particularly in FIG. 2. Especially as seen in FIG. 3, a gas outlet device 8 is provided for the convection-heated boiler 3 in the region between gasification reactor 1 and the convection-heated boiler 3, with which the crude gas is guided from the boiler housing 5 and the pressurized vessel 6. The curved convection path of the crude gas flowing from the convection-heated boiler 3 results from the guiding provided with the help of the vane elements 8*a*. The design is such that troublesome cinders and ash particles travel with the crude gas and are not deposited on apparatus surfaces. The cooling of the crude gas and thus the cinder particles is conducted to such an extent that baking on of these cinders is not possible. The gasification reactor 1 is supported in the lower portion of the pressurized vessel 6 at the anchoring points 9.

The convection heated surface elements 4 are supported by the quenching pipe 2 and the boiler housing 5. The quenching pipe 2 and the boiler housing 5 are mounted with their bottom portion on load bearing members 10 above the gas outlet device 8. The load bearing members 10 have crude gas conducting openings 11 and are supported on the pressurized vessel 6. The load bearing members 10 are secured to the pressurized vessel 6 at other anchoring points 12 as shown particularly in FIGS. 3, 5 and 6.

Figure 4:
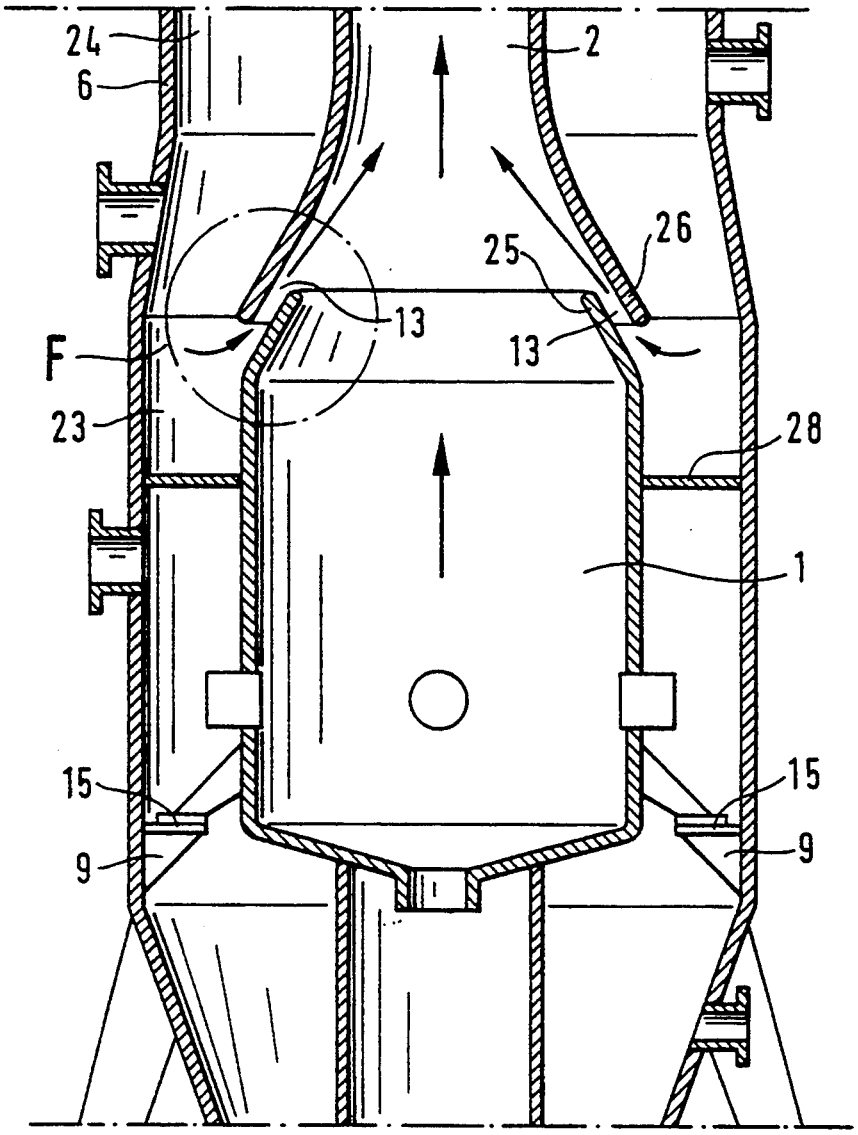
FIG. 4 is a detailed cutaway cross-sectional view of a bottom portion C of the gasification apparatus of FIG. 1.

Particularly from FIG. 4, one sees that a quenching gas guide means is provided between the gasification reactor 1 and the quenching pipe 2, which comprises a quenching gas inlet gap 13 between the quenching pipe 2 and the gasification reactor 1. The gap 13 separates the quenching pipe 2 and the gasification reactor 1. This arrangement compensates for different thermal expansion rates of the portion of the gasification reactor 1 above the anchoring points 9 and of the portion of the quenching pipe below the load bearing members 10. Thus the quenching gas inlet gap 13 is dimensioned as a thermal expansion compensating gap.

In the embodiment of the invention shown in the drawing the pressurized vessel 6 is simultaneously a supporting means for the gasification reactor 1, the quenching pipe 2 and the convection-heated boiler 3 with the boiler housing 5 and is both stationary and stable. The above-described gas guide means 7 is a dome-like gas conducting device. The gas outlet device 8 has a mechanism 14 for the discharge of cinders and/or ash particles.

The gasification reactor 1 is supported on the brackets 15 attached to the pressurized vessel 6 in its lower part as seen in FIG. 4.

The convection heated surface elements 4 are attached on one end to the supporting crosspieces 16. The crosspieces 16 are connected to the quenching pipe 2 and to the boiler housing 5 in a stress-free manner to avoid stresses on the boiler housing and/or the quenching pipe arising from differing thermal expansion rates.

Figure 5:
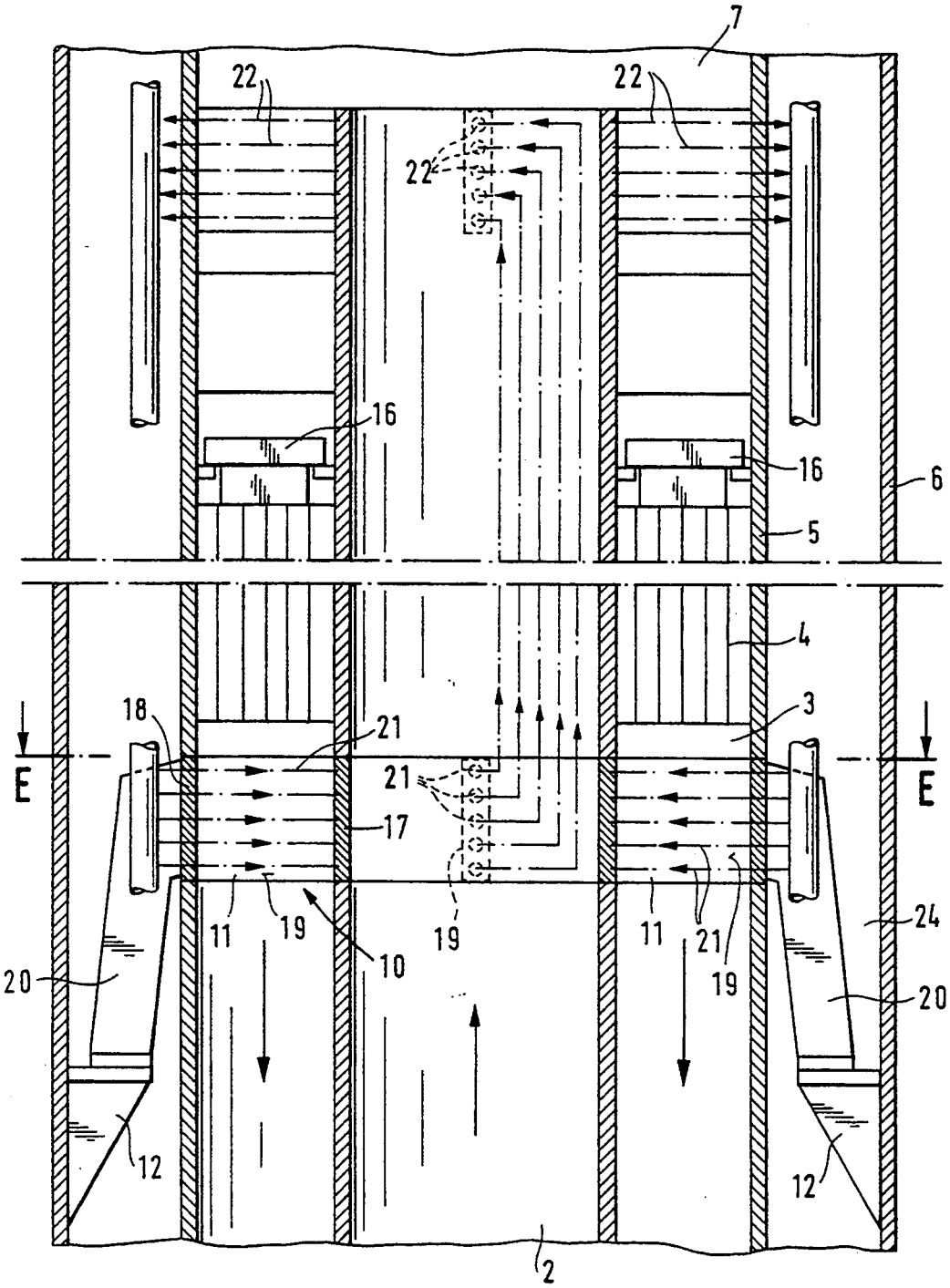
FIG. 5 is a detailed cutaway cross-sectional view of a portion D of the gasification apparatus of FIG. 3.
Figure 6:
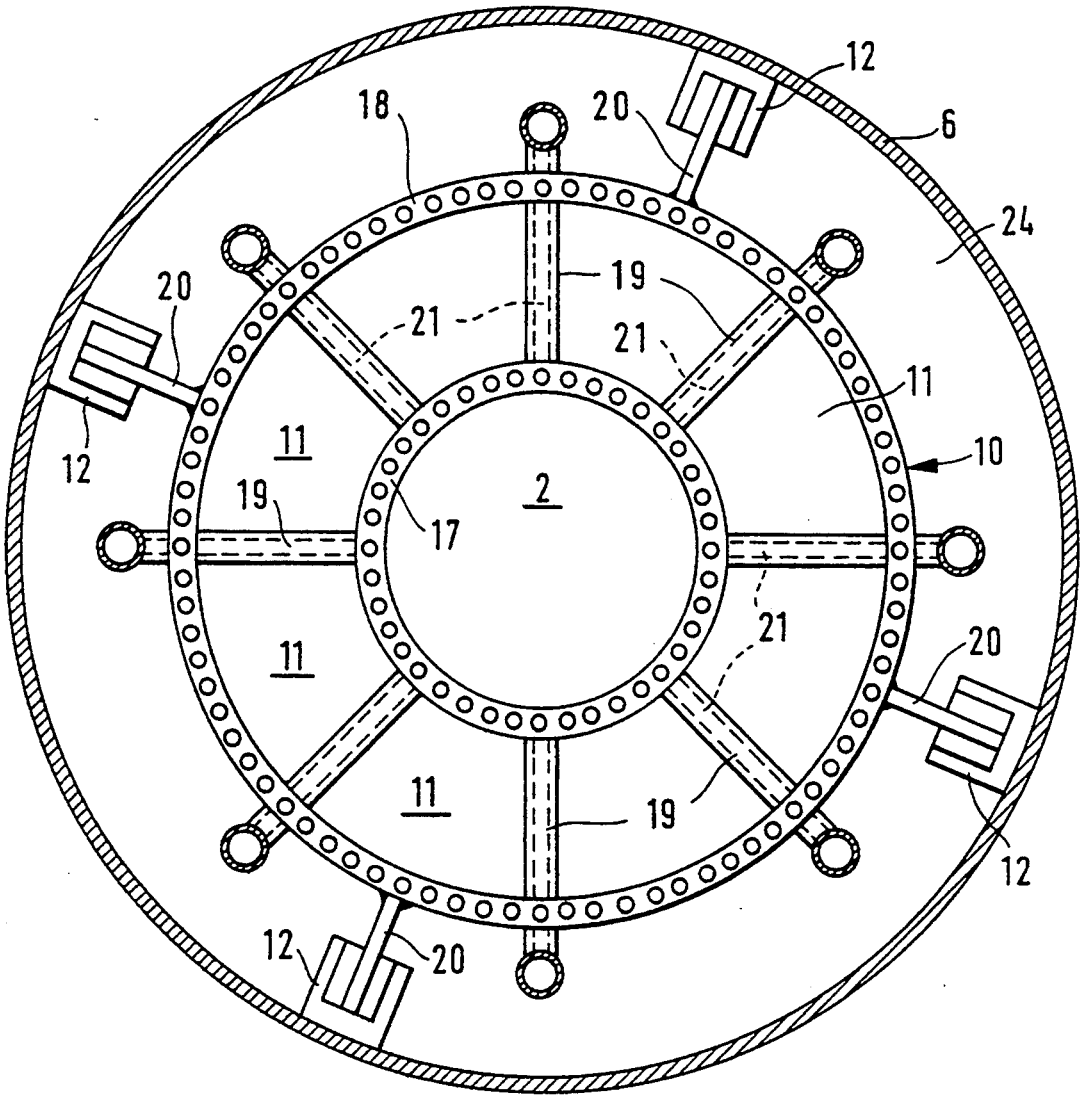
FIG. 6 is a detailed cutaway horizontal cross-sectional view of the gasification apparatus taken along the section line E—E of FIG. 5.

The individual components of the load bearing members 10 are seen in FIGS. 5 and 6. These components include the rigid, metallic elements including an inner ring 17, an outer ring 18 and spokes 19 connecting the inner ring 17 and the outer ring 18. The intervening spaces between the spokes 19 form the crude gas conducting openings 11. The components 17, 18 and 19 described above form a single piece, e.g. a forged piece. The load bearing members 10 are connected to the load receiving portions of the pressurized vessel 6 by heated supporting members or a heated frame 20 on the boiler housing 5. The load bearing members 10 simultaneously comprise conducting means for the boiling water of the boiling water cooling of the quenching pipe-shaped pipe ducts of the pipe wall of the quenching pipe 2 as shown in FIG. 5. The pipe ducts 21 are shown in FIG. 5. The boiling water is conducted away over thermally expandable discharge pipes 22 connected to the quenching pipe 2 and/or its pipe ducts 21. All pipe connections between the quenching pipe 2 and the boiler housing 5 are designed and arranged to be expandable during thermal expansion, apart from the pipe sections to and in the load bearing members 10.

The gasification reactor 1 forms a circular space 23 between it and the opposing wall of the pressurized vessel 6. The supplied quenching gases are guided through this circular space 23 to the quenching gas inlet gap 13. The circular space 23 is moreover connected with a pressure equalizing space 24, which is open between the boiler housing 5 and the walls of the pressurized vessel 6.

Figure 7:
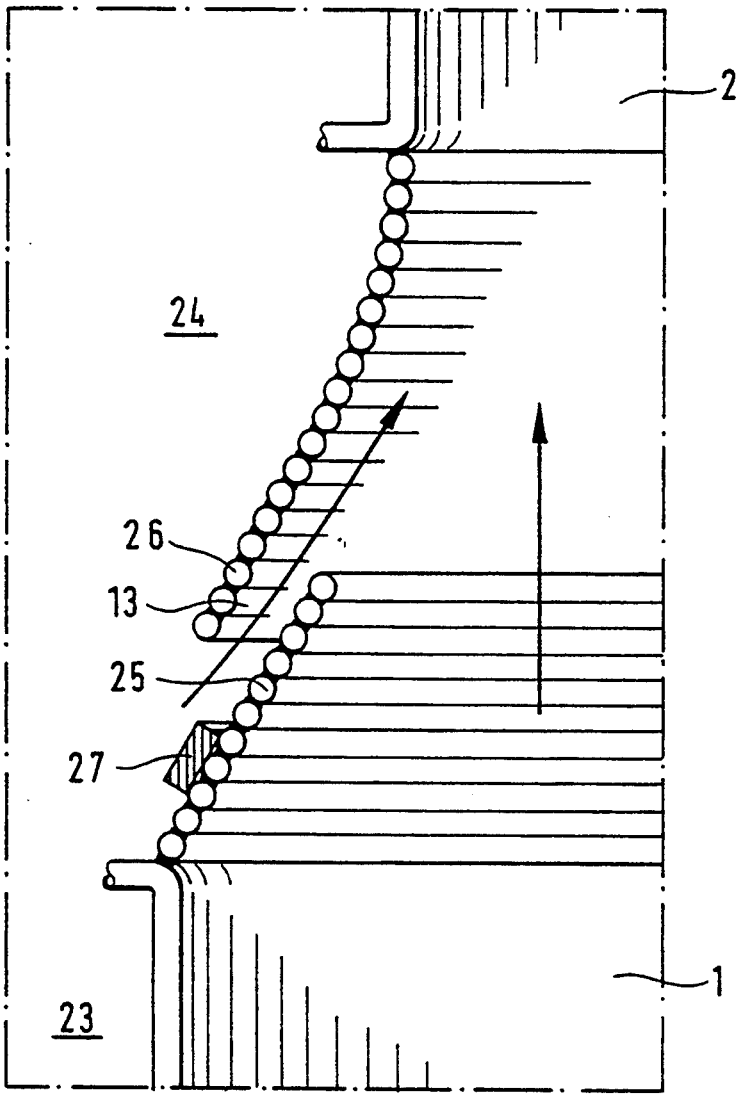
FIG. 7 is a detailed cutaway cross-sectional view of the region F of the gasification apparatus of FIG. 1.

The quenching gas inlet gap 13 is advantageously formed in a special way in the embodiment shown in FIG. 7. The quenching gas inlet gap 13 is formed between a frustrum-like outlet section 25 of the gasification reactor 1 and a complementary skirt 26 of the quenching pipe 2, which forms an inlet section of the quenching pipe. The outlet section 25 on the gasification reactor side is made from blank metal free of any fire-resistant lining. The cone angle of the frustrum amounts to about 60°. All downstream surfaces of the outlet section 25 are similarly free of fire-resistant coating. The outlet section 25 of the gasification reactor 1 is provided with a cleaning ring 27 and is movable periodically, e.g. with a clopping or knocking device.

To guarantee a clear flow direction for the quenching gas through the gap 13, the circular space between the circumferential wall of the gasification reactor 1 and the pressurized vessel 6 is closed by a membrane 28. The pressure balancing in the region under the membrane 28 occurs via cinder outlet openings in the base of the gasification reactor 1.

In operation the process according to the invention which is performed in the apparatus shown in FIGS. 1 to 7 is as follows:

A gasification reactor 1, a quenching pipe 2 and a convection-heated boiler 3 are arranged concentrically in a pressurized vessel 6, which is designed for performing a gasification of a finely-divided combustible material under pressure. The crude gas issuing axially upward from the gasification reactor 1 is fed into the quenching pipe 2 connected above it. A quenching gas is introduced. The mixed gas flow comprising the crude gas and the quenching gas is sometimes also designated as the crude gas in the following. This mixed gas flow is guided about a 180° turn by a gas guide means 7 which is rotationally symmetric with respect to the longitudinal axis L the quenching pipe 2 and in the form of a guide shield or baffle and causes a hollow cylindrical gas flow. The hollow cylindrical gas flow is fed into the hollow cylindrical-shaped convection-heated boiler 3, which surrounds the quenching pipe 2 concentrically. During outflow from the convection-heated boiler 3 the crude gas flow is drawn from the outlet from the convection-heated boiler 3 with the aid of a gas outlet device 8. The flow speed of the crude gas is next set so that cinders and ash components travelling with the crude gas around the 180° turn are deposited in the hollow cylindrical convection-heated boiler 3, in which they experience a cooling until they loose their ability to adhere. The flow in the gas outlet device 8 is thus adjusted so that the cinders and ash components flow out from the apparatus. The example shows that the gas flow guided past the concentric convection heated surface elements 4 in the convection-heated boiler 3 is cooled to a temperature of 400° to 200° C. at the entrance of the gas outlet device 8. The quenching gas is distributed uniformly circumferentially with the help of a circumferential quenching gas inlet gap 13 between the gasification reactor 1 and the quenching pipe 2. A spin flow is impressed on the crude gas flow in the gas outlet device 8 at the outlet from the convection-heated boiler 3. The flow speed and the spin or twist in the flow in the gas outlet device 8 are arranged so that the cinders and ash particles travelling with the flow are carried out of the gasification apparatus.

While the invention has been illustrated and described as embodied in an apparatus for gasification of a finely divided combustible material under pressure, it is not intended to be limited to the details shown above, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. Gasification process for gasification of a finely divided combustible material under pressure, said process comprising the steps of:

a) providing a gasification reactor having means for gasifying the finely divided combustible material under pressure to form a crude gas and cinder and ash components, a quenching pipe positioned concentrically above the gasification reactor, a convection-heated boiler concentrically surrounding the quenching pipe, the convection-heated boiler having a gas outlet device, and a gas flow guide device above the quenching pipe, the gas flow guide device being rotationally symmetric with respect to a longitudinal axis of the quenching pipe and connecting the quenching pipe and the convection-heated boiler;

b) conducting the crude gas and the cinder and ash components produced during the gasifying from the gasification reactor into the quenching pipe positioned above the gasification reactor;

c) feeding a quenching gas into the quenching pipe during the gasifying to form a mixed flow, said mixed flow comprising said crude gas, said cinder and ash components and said quenching gas;

d) guiding said mixed flow about a 180° turn by said gas flow guide device above said quenching pipe;

e) conducting the mixed flow into the convection-heated boiler from the gas flow guide device;

f) feeding said mixed flow from said convection-heated boiler with the help of the gas outlet device; and g) adjusting a gas flow speed of said mixed flow so that said cinder and ash components travelling in said mixed flow in said convection-heated boiler experience a cooling in said convection-heated boiler so that said cinder and ash components loose adherence ability and are conducted through said gas outlet device from said convection-heated boiler.

2. Gasification process as defined in claim 1, further comprising conducting said mixed flow past convection-heated surface elements in said convection-heated boiler and cooling said mixed flow thereby to a temperature of from 400° to 200° C. at said gas outlet device.

3. Gasification process as defined in claim 2, further comprising feeding said quenching gas through a quenching gas inlet gap provided between said gasification reactor and said quenching pipe in a transverse flow into said crude gas and said cinder and ash components to form said mixed flow and uniformly distributing said quenching gas over an entire circumference of said quenching gas inlet gap during said feeding of said quenching gas through said inlet gap.

4. Gasification process as defined in claim 3, wherein said quenching gas inlet gap is unobstructed by structural components.

5. Gasification process as defined in claim 1, further comprising providing means for impressing a spin flow on said mixed flow from said convection-heated boiler through said gas outlet device to assist in conducting said cinders and said ash components travelling in said mixed flow from said convection-heated boiler.

* * * * *